United States Patent [19]

Bansbach et al.

[11] Patent Number: 4,554,619

[45] Date of Patent: Nov. 19, 1985

[54] LAMP WITH A LINEAR LIGHT SOURCE

[75] Inventors: Armin Bansbach; Helmut Senkel, both of Berlin, Fed. Rep. of Germany

[73] Assignee: Semperlux GmbH, Berlin, Fed. Rep. of Germany

[21] Appl. No.: 658,614

[22] Filed: Oct. 9, 1984

[30] Foreign Application Priority Data

Oct. 18, 1983 [DE] Fed. Rep. of Germany ... 8330300[U]

[51] Int. Cl.[4] ..... F21S 7/00

[52] U.S. Cl. ..... 362/222; 362/217; 362/225; 362/228; 362/249

[58] Field of Search ..... 362/217–228, 362/249, 260, 335, 368, 370, 382, 384, 404

[56] References Cited

U.S. PATENT DOCUMENTS

| | | | |
|---|---|---|---|
| 3,928,757 | 12/1975 | Nelson | 362/228 |
| 4,338,653 | 7/1982 | Marrero | 362/217 X |
| 4,390,930 | 6/1983 | Herst et al. | 362/223 X |
| 4,415,957 | 11/1983 | Schwartz | 362/217 X |
| 4,420,798 | 12/1983 | Herst et al. | 362/220 X |

FOREIGN PATENT DOCUMENTS

| | | | |
|---|---|---|---|
| 144780 | 11/1979 | Japan | 362/228 |
| 958330 | 5/1964 | United Kingdom | 362/221 |

*Primary Examiner*—Tony M. Argenbright
*Attorney, Agent, or Firm*—Michael J. Striker

[57] ABSTRACT

A lamp includes a housing in which a wiring and a switching circuit are accommodated. A linear light source, which can be a hot cathode lamp or a cold cathode lamp, is located outside the lamp and is at least partially accommodated in a recess provided in the lamp housing and opened outwardly.

17 Claims, 9 Drawing Figures

LAMP WITH A LINEAR LIGHT SOURCE

BACKGROUND OF THE INVENTION

The present invention relates to a lamp which is provided with a linear light source.

Lamps of the type under consideration have been known. These lamps include a tubular or box-like housing in which a switching arrangement or circuit is accommodated, and which lamps are provided with an associated linear light source.

The lamps of the foregoing type have been provided for the illumination of rooms with linear white or color light sources used for a decoration purpose. Such linear light sources can be for example glow lamps, hot cathode lamps (fluorescent lamps) or cold cathode lamps (neon tubes).

It has been, however rather difficult to arrange these linear light sources on the lamp such as to provide a clear light radiation and to prevent an excessive glaring effect without, however, buying and using an expensive auxiliary equipment.

SUMMARY OF THE INVENTION

It is an object of the present invention to provide an improved lamp of the type under discussion.

It is another object of this invention to provide a lamp which would enable an arrangement of linear light sources with clear radiation and at the same time would lower light intensity to sufficiently reduce a glaring effect due to a specific arrangement of these light sources.

These and other objects of the invention are attained by a lamp, comprising a housing having an inspection cover and formed with a suspension groove, a chamber for accommodating a wiring, and further including fixtures for weldless longitudinal joints and fixtures for receiving lamp supports; a switching circuit device; and at least one linear light source, said housing being provided with at least one continuous recess which is open outward of said housing, said linear light source being at least partially accommodated in said recess.

Two such recesses may be formed in said housing at lateral sides thereof, each recess at least partially accommodating the linear light source.

The linear light source may be entirely accommodated in said recess.

The lamp may further include a contacting rail which may be arranged in the housing above or below the linear light source.

The lamp may further include at least one shaded fluorescent lamp accommodated in said housing.

The fluorescent lamp may be arranged in said housing so as to emanate light in an upward or downward direction.

The lamps may be used as individual lamps, such as a light strip, as a unit adjusted between two walls, or as a structure mounted on a miter, and wherein the linear light sources utilized would be optically transparent. Such operational means as lamp supports, or the necessary starter switch and the switch circuit are integrated in the lamp.

In the case of the use of suitable connecting elements raster or polygon structures could be employed. The combination of the linear light sources positioned outwardly of the lamp housing with the contact rails which also are accessible from outside for the application thereto of other additional lamps, for example radiators, offers a universal solution of all illumination problems encountered in the field.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
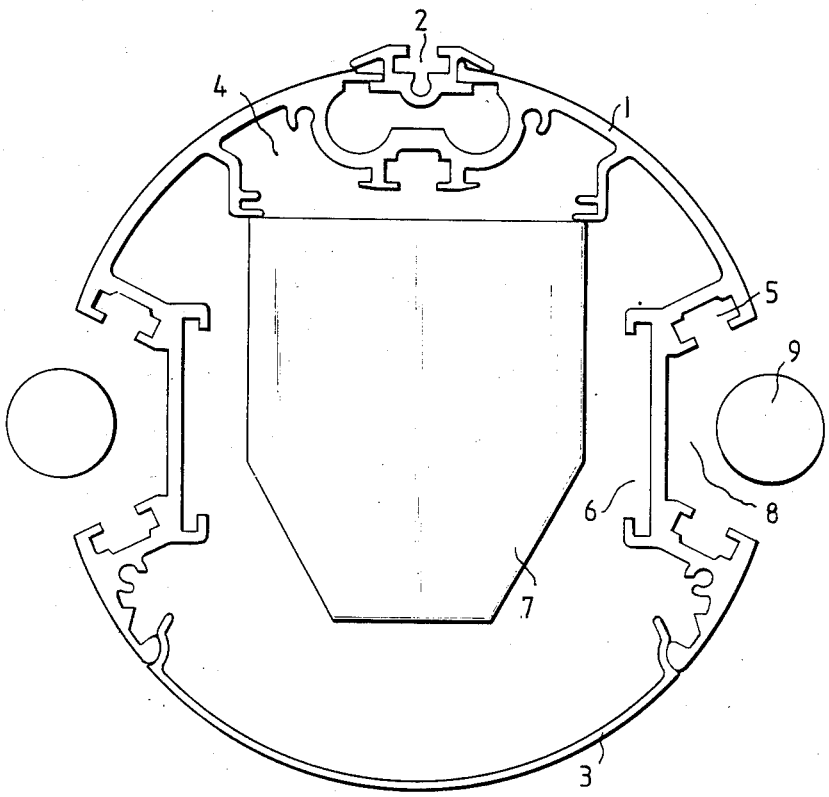
FIG. 1 is a schematic view of the lamp provided with two linear light sources positioned at two sides of the lamp housing.

Referring now to the drawings more specifically, and firstly to FIG. 1 thereof, reference numeral 1 designates an elongated housing of the lamp. Housing 1 is provided with a suspension groove 2 at the upper side of the tubular housing. An inspection cover 3 is provided in this embodiment at the underside of the tubular housing. Housing 1 and cover 3 enclose an interior of the lamp, in which a chamber 4 is formed, which accommodates a non-shown wiring. Fixtures 5 are provided for weldless longitudinal joints. Reference numeral 7 denotes a switching circuit device.

It should be noted that some similar structural components in all the embodiments are designated in all the figures of the drawings by identical reference numerals.

Figure 3:
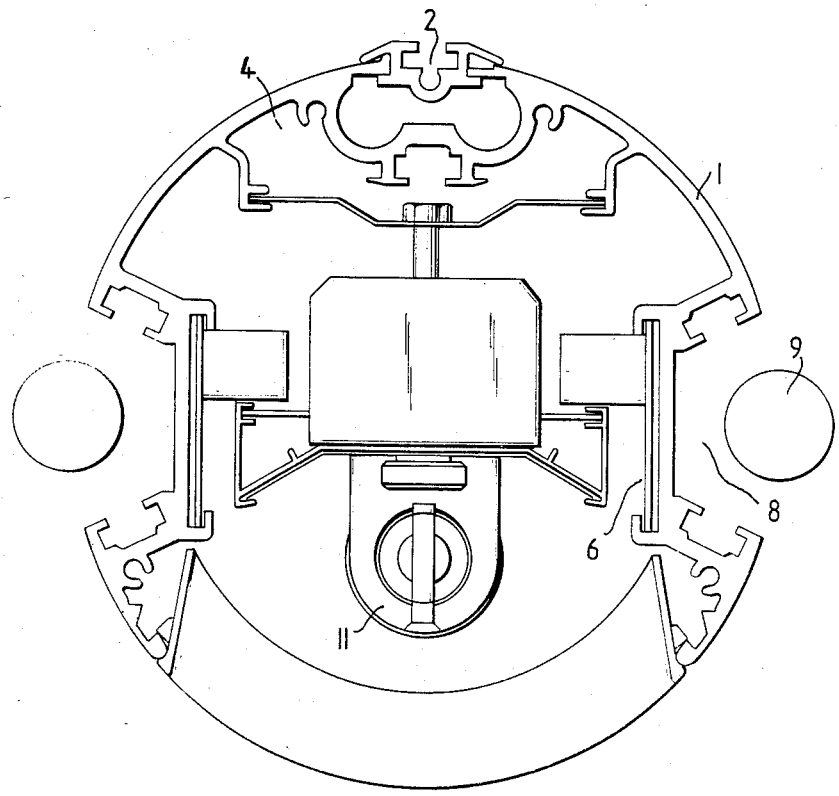
FIG. 3 is a schematic view of the lamp shown in FIG. 1 but provided with an additional fluorescent lamp.
Figure 4:
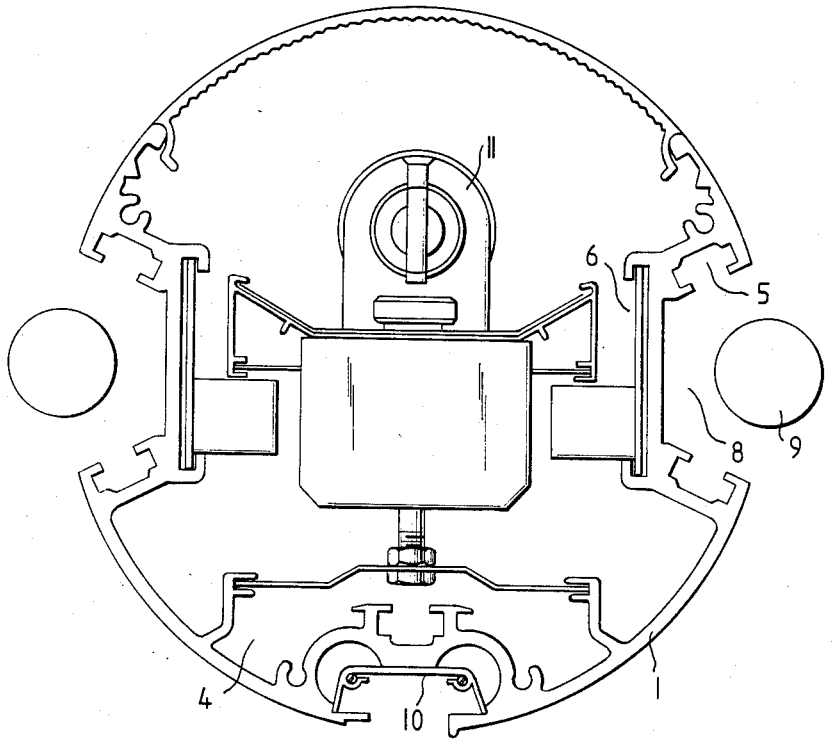
FIG. 4 is a schematic view of the lamp shown in FIG. 3 but provided with an additional contacting rail.
Figure 5:
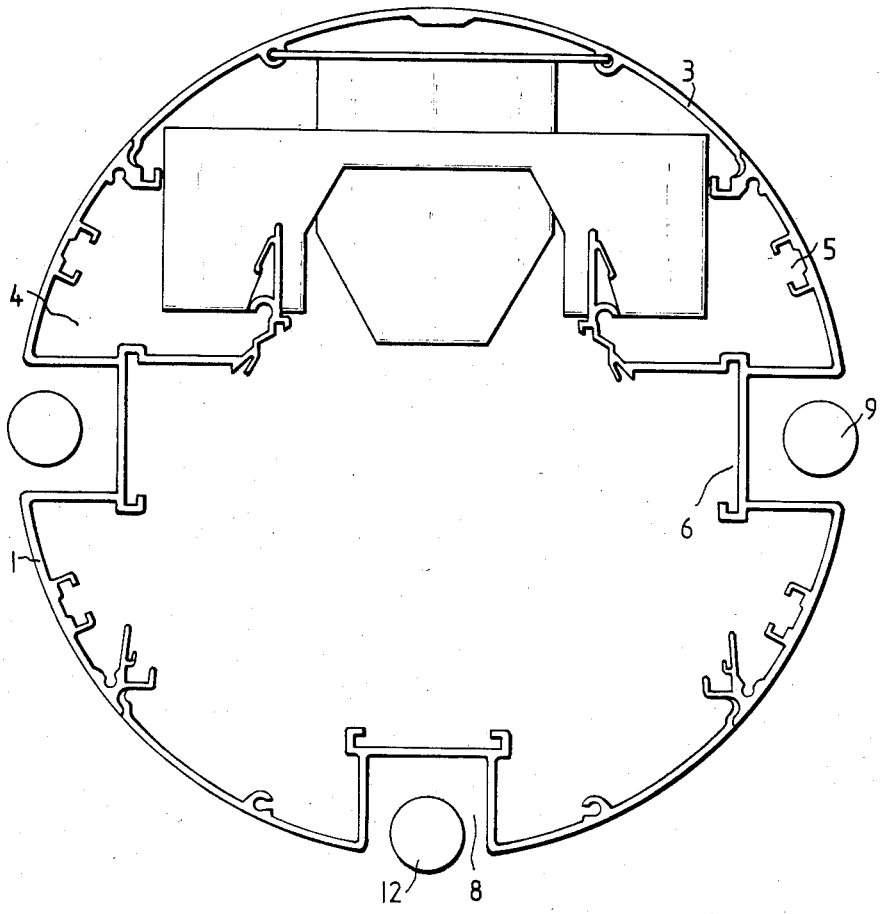
FIG. 5 is a schematic view of the lamp shown in FIG. 1 but provided with an additional linear light source on the underside.

FIGS. 3, 4 and 5 additionally show a device 6 for receiving lamp supports.

Figure 2:
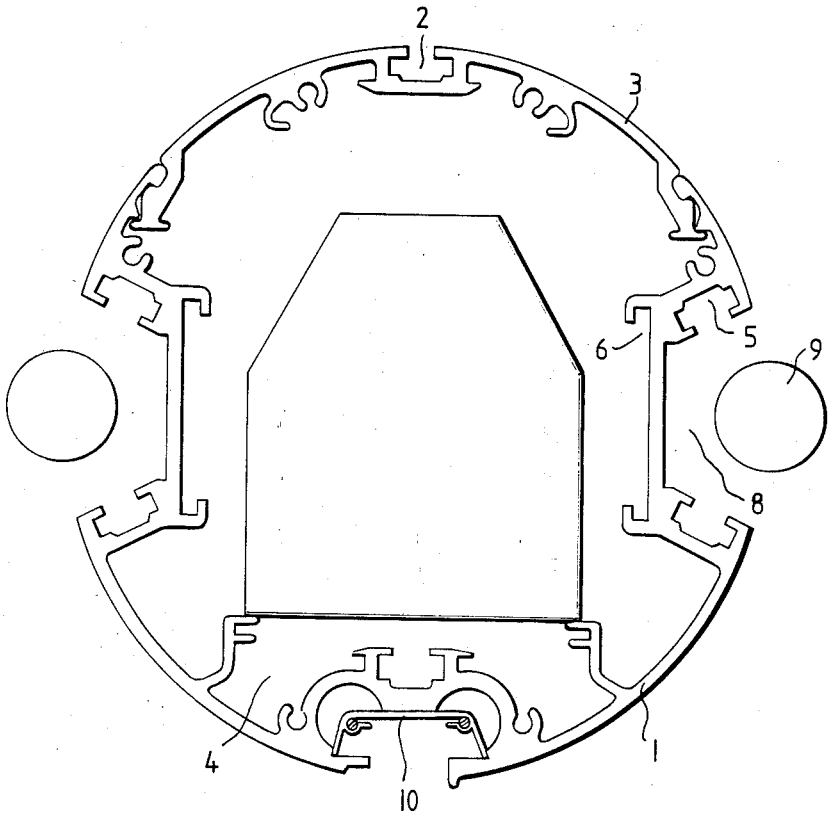
FIG. 2 is a schematic view of the lamp shown in FIG. 1 but additionally provided with a contacting rail.

The lamp housing 1 in FIG. 1 has at two sides two continuous grooves or recesses 8 which open outwardly and extend over the length of the tubular housing. Two linear light sources, which can be bulbs, or hot cathode, or cold cathode lamps, are partially immersed in recesses 8. FIGS. 2 through 4 also illustrate the lamps having two laterally arranged light sources 9 each of which is partially accommodated in a respective side recess 8. In the embodiment depected in FIG. 6 only a single light source denoted by reference numeral 12 is provided, which is partially accommodated in the groove 8, formed on the underside of the tubular housing. The switching device 7 is in this embodiment accommodated in the interior of the housing 1.

In the embodiment of FIG. 2 inspection cover 3 is arranged on the top side of the housing, switching device 7 is located in the housing, and the lamp is provided with a contacting rail 10 arranged in the lower portion of the housing so that other additional lamps or light sources could be adjoined to this lamp.

In the embodiment of FIG. 3 a fluorescent lamp 11 is accommodated in housing 1, which lamp is shaded and emanates light in the downward direction, while in the embodiment of FIG. 4 the fluorescent lamp is arranged in the housing 1 so that it emanates light in the upward direction. In the embodiment of FIG. 4 contact rail 10 is additionally provided.

In the embodiment of FIG. 5 the lateral light sources 9 and the lower light source 12 provided on the underside of the tubular housing 1 are entirely immersed in respective grooves or recesses 8.

Figure 6:
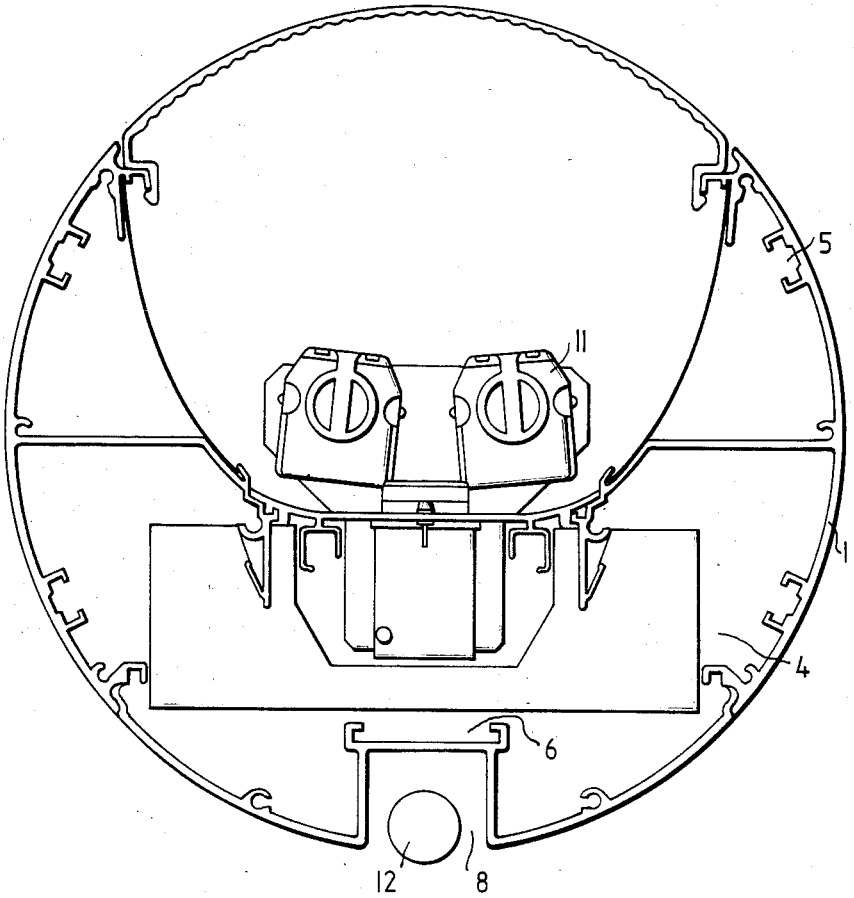
FIG. 6 is a schematic view of the lamp similar to that shown in FIG. 3 but provided with two fluorescent lamps and a single linear light source.

In the modification illustrated in FIG. 6 the single linear light source is provided on the underside of the housing and is entirely enclosed in groove 8 while two fluorescent shaded lamps are arranged in the housing, which emanate light in the upward direction.

Figure 7:
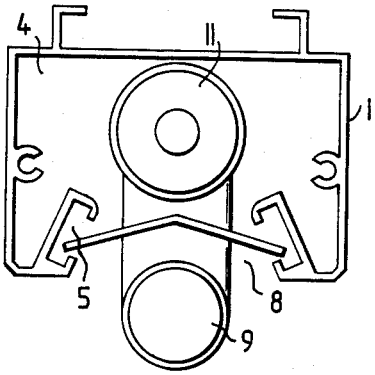
FIG. 7 is a schematic view of the lamp having a box-shaped housing and provided with an additional linear light source on the underside.
Figure 9:
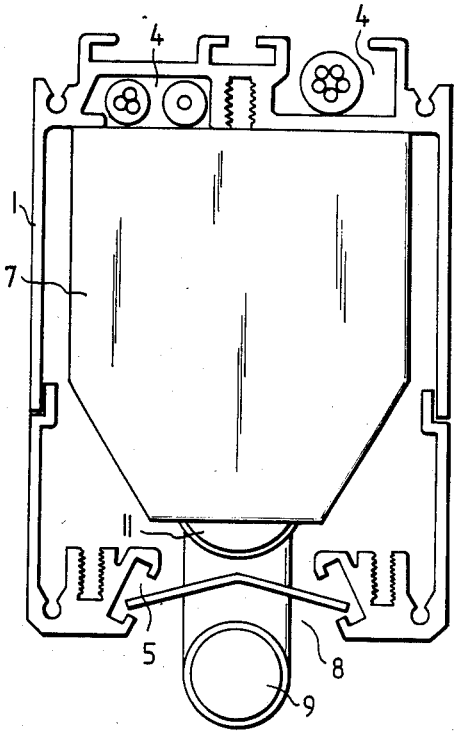
FIG. 9 is a schematic view of the lamp shown in FIG. 7 but with the switching circuit arranged in the housing of the lamp.
Figure 8:
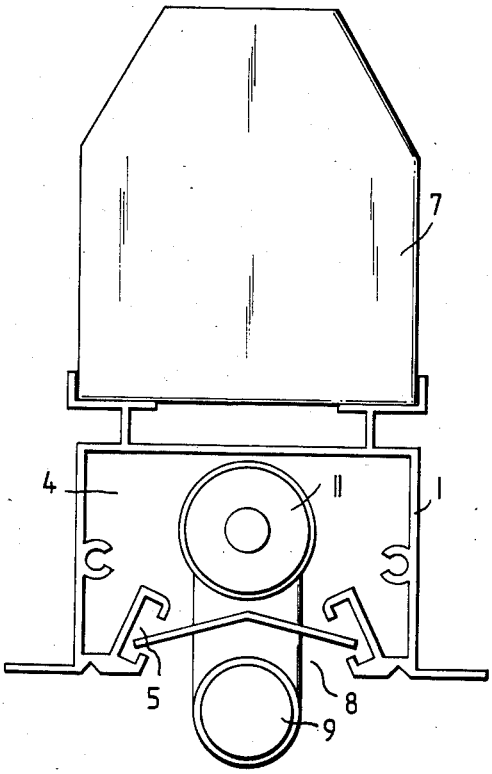
FIG. 8 is a schematic view of the lamp similar to that of FIG. 7 but with the switching circuit disposed outside the lamp housing.

FIGS. 7 through 9 show the embodiments in which the tubular elongated housing 1 has a rectangular cross-section instead of a circular cross-section as shown in FIGS. 1–6. In these modified embodiments housing 1 encloses a chamber 4 for accommodating a wiring, and fixtures 5 are provided for weldless longitudinal joints. A fluorescent lamp 11 is accommodated in the housing while an additional linear light source 9 is partially located in a recess 8 formed on the underside of the housing and opening downwardly.

In the embodiment of FIG. 8 the switching circuit device is arranged outside the housing while in the construction of FIG. 9 this device is accommodated in the housing 1.

It will be understood that each of the elements described above, or two or more together, may also find a useful application in other types of lamps with linear light sources differing from the types described above.

While the invention has been illustrated and described as embodied in a lamp with a linear light source, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lamp, comprising a housing having an inspection cover and formed with a suspension groove, a chamber for accommodating a wiring, and further including fixtures for weldless longitudinal joints and fixtures for receiving lamp supports; a switching circuit device; and at least one linear light source, said housing being provided with at least one continuous recess which opens outward of said housing, said linear light source being at least partially accommodated in said recess.

2. The lamp as defined in claim 1, wherein two such recesses are formed in said housing at lateral sides thereof, each recess at least partially accommodating the linear light source.

3. The lamp as defined in claim 1, wherein said linear light source is entirely accommodated in said recess.

4. The lamp as defined in claim 1, further including a contacting rail.

5. The lamp as defined in claim 4, wherein said contacting rail is arranged in said housing above said light source.

6. The lamp as defined in claim 4, wherein said contacting rail is arranged in said housing below said light source.

7. The lamp as defined in claim 1, further including at least one shaded fluorescent lamp accommodated in said housing.

8. The lamp as defined in claim 7, wherein said fluorescent lamp is arranged in said housing so as to emanate light in an upward direction.

9. The lamp as defined in claim 7, wherein said fluorescent lamp is arranged in said housing so as to emanate light in a downward direction.

10. The lamp as defined in claim 7, further including a contacting rail.

11. The lamp as defined in claim 10, wherein said contacting rail is arranged on an underside of said housing.

12. The lamp as defined in claim 10, wherein said contacting rail is arranged on a top side of said housing.

13. The lamp as defined in claim 10, wherein said linear light source is positioned on an underside of said housing.

14. The lamp as defined in claim 13, wherein said fluorescent lamp is arranged in said housing so as to emanate light in an upward direction.

15. The lamp as defined in claim 14, wherein said switching circuit device is accommodated in said housing.

16. The lamp as defined in claim 1, wherein said housing is tubular and has a circular cross-section.

17. The lamp as defined in claim 1, wherein said housing is tubular and has a rectangular cross-section.

* * * * *